US007390181B2

(12) United States Patent
Arnold

(10) Patent No.: US 7,390,181 B2
(45) **Date of Patent: *Jun. 24, 2008**

(54) ROTATING PISTON MACHINE

(75) Inventor: Felix Arnold, Stuttgart (DE)

(73) Assignee: COR pumps + compressors AG, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/571,244

(22) PCT Filed: Sep. 10, 2004

(86) PCT No.: PCT/DE2004/002034

§ 371 (c)(1),
(2), (4) Date: May 2, 2006

(87) PCT Pub. No.: WO2005/024237

PCT Pub. Date: Mar. 17, 2005

(65) Prior Publication Data

US 2006/0263228 A1 Nov. 23, 2006

(30) Foreign Application Priority Data

Sep. 11, 2003 (DE) ..... 103 42 341

(51) Int. Cl.
*F03C 2/00* (2006.01)
*F04C 18/00* (2006.01)

(52) U.S. Cl. ..... 418/195; 418/68; 418/109

(58) Field of Classification Search ..... 418/68, 418/104, 109, 144, 193, 195; 123/230, 221, 123/228, 241
See application file for complete search history.

(56) References Cited

U.S. PATENT DOCUMENTS

| | | | | |
|---|---|---|---|---|
| 2,662,482 | A * | 12/1953 | Paulsmeier et al. | 418/68 |
| 2,831,436 | A * | 4/1958 | Schmidt et al. | 418/195 |
| 3,101,700 | A * | 8/1963 | Bowdish | 418/195 |
| 3,236,186 | A | 2/1966 | Wildhaber | |
| 4,981,424 | A | 1/1991 | Bein | |
| 5,513,969 | A | 5/1996 | Arnold | |
| 6,032,636 | A * | 3/2000 | Kajino | 418/68 |
| 6,676,394 | B2 * | 1/2004 | Bodzak | 418/109 |
| 7,052,257 | B2 * | 5/2006 | Bodzak | 418/109 |

FOREIGN PATENT DOCUMENTS

| | | |
|---|---|---|
| DE | 1 551 081 | 4/1970 |
| DE | 1551081 | 4/1970 |
| DE | 42 41 320 | 6/1993 |
| DE | 103 35 939 | 4/2004 |
| JP | 2002-364572 | 12/2002 |

* cited by examiner

*Primary Examiner*—Theresa Trieu
(74) *Attorney, Agent, or Firm*—Jordan and Hamburg LLP

(57) ABSTRACT

A rotary piston machine has a driving part which is driven by an electric motor and a driven part which are geared together and engage one another for the delivery of a medium, the driven part being put under load in the direction of the driving part and the driven part being disposed on a bearing bushing at an appropriate angle to the driven part.

14 Claims, 1 Drawing Sheet

3
12
4
17
9
1
II
II
24
22
18
7
2
8
6
5
11
20
13
23

12
14
16
VI
15
31

27
21
22
25
28
I
24
21
10

31

17
18
19
30
29
25
19

31
31

ROTATING PISTON MACHINE

BACKGROUND OF THE INVENTION

The invention relates to a rotary test machine. A rotary piston machine is known (German patent 4241320) which includes a pump, compressor or motor, for which the ridges of teeth of a rotating driving parts, in order to limit the working spaces, run on a cycloid surface of an also toothed driven part, driving the latter. The aforementioned working spaces, which are increased or decreased in size for their work during the rotation of the parts, in order to produce the delivery action on a medium, are formed between the teeth of the driving and driven parts.

It has also already been proposed (patent application DE 103 35 939.7 of Aug. 2, 2003) that a portion of the machine housing be mounted in a "floating manner", in order to be able to better equalize gap losses and the like by these means. However, such a floating arrangement has the disadvantage that, at the expense of a decrease in the losses through the gap, the danger of imbalances arise. The significance of this disadvantage depends on the practical use of the object, the rpm then actually employed and the pressure aimed for playing an important roll.

SUMMARY OF THE INVENTION

Compared to the foregoing, the inventive rotary piston machine has the advantage that it can be used especially in the delivery system of fuel-burning engines, for example, as a pre-delivery pump for diesel injection installations or as a pre-delivery pump or a pressure and supplying pump of gasoline injection installations. The combination as a unit between the engine housing and the machine housing offers the possibility of making such a delivery pump or pressure pump small, since, on the driven side, the electric motor can engage the driving part of the rotors directly, without an additional, expensive mounting. The housing can be connected in different ways, for example, as a screw connection between two "pots", which embrace, on the one hand, the pump and, on the other, the electric motor, or there may be beading between a lid part and a pot part, depending on how this appears to be meaningful for practical use and, above all, for being able to produce advantageously. It is of decisive importance for the invention that the parts, which relate to the electric motor, such as the magnets and the mounting of the rotor, are disposed in the machine housing and that the pump parts, including the inflow and outflow device for the medium, are accommodated in the machine housing.

In order to arrive at this structural unit, it was necessary to overcome a bias, which consists particularly therein that a driving mechanism of the driving part requires an axial adjustment, over which even slight eccentricities of the axles of the motor and the driving element can be corrected. The endeavor to dispose the driving part in a floating manner in the housing also permits this problem to be recognized, especially if a frictional connection is desired between the drive shaft of the motor and the rotor functioning as driving part. It is pointed out here that, especially in vehicle construction and the use of a fuel delivery pump in a motor vehicle, the aim is to keep the development of noise to a minimum. However, even the slightest imbalances would already lead to appreciable noise. This makes the problem, on which the invention is based, even clearer.

Admittedly, the claimed bearing bushing has already been proposed earlier. However, it does not belong to the state of the art and plays an appreciable role in connecting applicant's individual distinguishing features and their developments.

Such an inventive "electric pump" is not limited in its application to a fuel delivery pump and, instead, depending on its size and efficiency, can be used for liquid media or gaseous media. In such a case, however, significantly higher pressures can be produced than in the case of a known fuel delivery pumps (Robert Bosch GmbH or the like).

In accordance with an advantageous development of the invention, there is, due to the rotation of the bearing bushing of the driving part, a change in the rotational position of the working spaces relative to the suction and pressure channel and, with that, to the working phase of the working spaces in relation to the suction channel and pressure channel. The adjustment, which is presented as a problem above, is accomplished in a simple manner by these means.

According to an additional development of the invention, the bearing bushing is connected with a bottom bearing for the driven part, at which the driven part is supported on a side, which is averted from the driving part. The bearing bushing and the bottom bearing have the same axle here, which rests perpendicularly on the bearing surface, on which the driven part is supported. By rotating this bottom bearing on the main axle within the machine housing, the above-mentioned relative adjustment, from the start of the delivery to the inflow and outflow channels, is shifted relatively, with the result that the delivery performance of the machine is changed.

According to an additional advantageous development of the invention, the rotors run in an inner housing, in which the suction channel, which is open towards the rotors, and the pressure channel are disposed. This inner housing is disposed within the rest of the machine housing so that it does not rotate and does not float and, in particular, is secured against rotating with respect to the bottom bearing. In this connection, the inner housing may be disposed in an additional housing bushing and secured there, so that it cannot twist. This housing bushing, in turn, may be mounted in the outer machine housing.

In accordance with an additional advantageous development of the invention, the rotors run in a recess (of the inner housing), which is open and cylindrical towards the driven side and closed and spherical towards the driving side. The driving part can be supported at this spherical surface, whereas the driven part is held in its working position on the cylindrical side by the bearing bushing and the bottom bearing.

According to an additional, advantageous development of the invention, the driving part has an inner, spherical region, at which the driving part is supported with a correspondingly configured front face or can support the bearing bushing of the driven part. By these means, the inner region of the rotors, close to the axis of rotation, which is less effective anyhow, is not used for the pump function, so that the more effective sections of the rotors, which lie radially further to the outside, form the working spaces.

According to an additional, advantageous development of the invention, the driven part is loaded axially in the direction of the driving part.

According to a development of the invention, which is advantageous in this regard, the driven part is put under a load in the direction of the driving part by the force of a spring. Such a force may be of advantage, particularly in the starting phase of such a pump, in order to achieve the tightness between the working flanks of mutually meshing teeth required for the delivery.

In accordance with a possible, additional development of the invention in this regard, the pressure channel of the machine is connected with a space between the driven part and the housing (bottom bearing) on the side averted from the driving part. By these means, it is achieved that, when the medium in the pressure channel has reached a certain pressure, the driven part is pressed against the driving part in such a manner, that a better tightness between the flanks can be achieved by this pressure.

In accordance with an additional advantageous development of the invention, the rotor is mounted with its shaft in a fixed bearing, which is carried by the inner housing and at which the driving part can be supported axially. Accordingly, it is a question of a radial bearing for the motor as well as an axial bearing for the driving part, the latter, in particular, bringing about a reduction in fictional losses between the driving part and the inner housing.

In accordance with an additional, advantageous development of the invention, advanced for itself, the transitions at the rotors between the mutually facing spherical supporting surfaces providing axial support and the surfaces of the teeth, limiting the working space, are rounded off.

By means of such a rounding off, on the one hand, a greater tightness is achieved between the boundaries of the working spaces, leading to an improvement in the effective pressure and delivery action of such a pump, and, on the other, the processing of pump parts in these sections of the manufacturing process is simplified, quite apart from the fact that the danger of chip formation by the sharp-edged parts is avoided. The radius of such rounded off edges preferably is at least 1 mm. Basically this radius is independent of the size of the pump parts.

According to an additional development of the invention, which is, however, also advanced for itself, short-circuit channels or short-circuit grooves, over which, during the rotation and, in particular, before the suction or pressure channels are opened up, adjacent working spaces can be connected with one another in order to achieve pressure equalization in the working spaces of changing capacity, are disposed in the bottom surface of the rotors. During the rotation of the driven and driving parts and before the suction channel is opened up, the delivery spaces between the parts change, the assigned flanks of the teeth of the one part sliding over corresponding surfaces of the other part, so that the spaces between the teeth, from which the actual working spaces result, act here as harmful spaces. An overpressure would result in the one harmful place and a reduced pressure would result in the adjacent space. Due to the invention, the pressure in the spaces is equalized to the benefit of the efficiency of the pump.

Further advantages and advantageous developments of the invention can be inferred from the following description, the drawing and the claims.

An example of the object of the invention is described in greater detail in the following and shown in the accompanying drawings.

DESCRIPTION OF THE PREFERRED EMBODIMENTS

Figure 1:
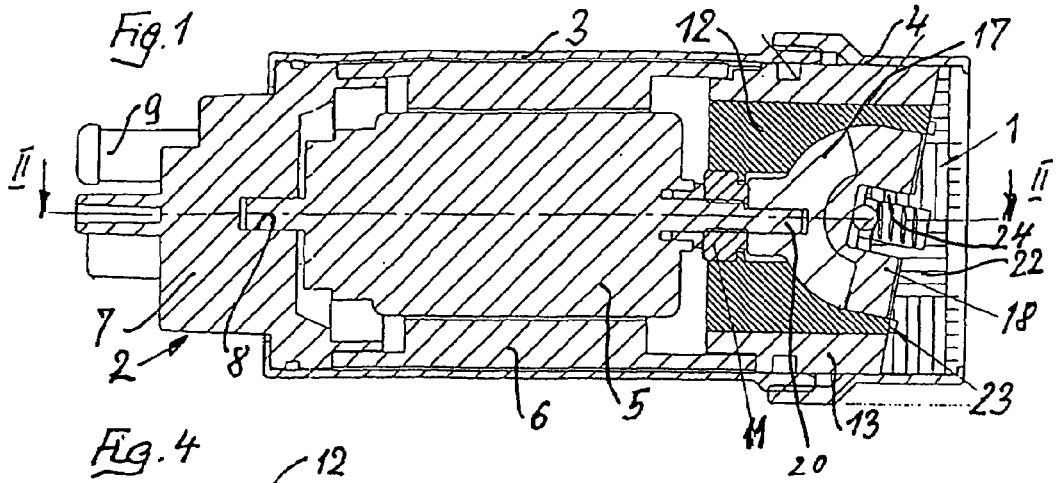
FIG. 1 shows the inventive fuel delivery pump in the longitudinal section corresponding to arrow I in FIG. 2.

The fuel delivery pump shown has a rotary piston pump 1 and an electric motor 2, which drives this pump 1 and is disposed in a motor housing 3, onto which a housing lid 4 is bolted. In this connection, especially the electric motor is shown in a highly simplified fashion with a rotor 5 and a magnet ring 6, as well as an axial locking part 7 of the motor housing 3, which is connected with the motor housing 3, to which it is sealed. In addition, a pivot bearing 8 of the rotor 5, as well as the pressure connection 9 for the fuel discharging pipeline are disposed at this locking part 7. The fuel delivery pump is constructed as an immersion pump, for which the fuel reaches the pump over suction ports 10, which are only indicated here, in order to leave the pump once again then over the pressure connection 9. The fuel, within the motor housing 3, flows around the electric motor 5, 6 here.

The second rotational bearing of the rotor 5 is constructed as a fixed bearing 11, which is disposed in an appropriate borehole at the front side of the inner housing 12 of the rotary piston pump 1 and at which the driving part 17 can be supported axially. This inner housing 12 is disposed on the outside in a housing bushing 13, which once again is sealed from the motor housing 3 and clamped partially in the latter and partially within the housing lid 4.

Figure 4:
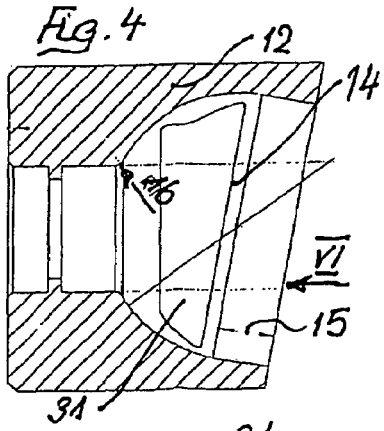
FIG. 4 shows the inner housing of the pump in a longitudinal section.

As can be inferred particularly from FIG. 4, a recess 14 with a cylindrical section 15 and a spherical section 16 is provided in the inner housing 12.

Figure 2:
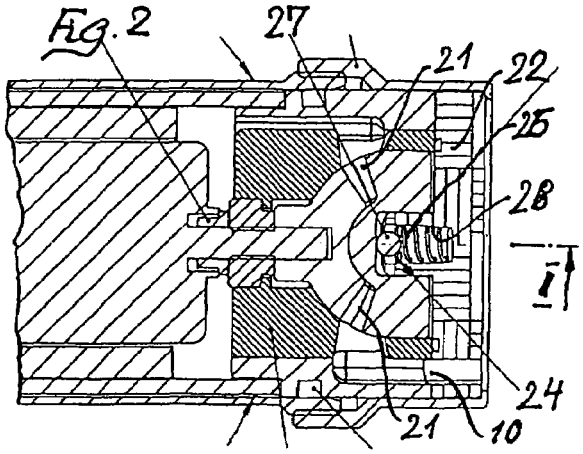
FIG. 2 shows a longitudinal section through the delivery pump corresponding to the line II-II in FIG. 1.

Two pump rotors work in this recess 14, namely a driving part 17 and a driven part 18. The driving part 17 is driven by the shaft 20 of the electric motor 2 and transfers the rotational movement of the latter to the driven part 18. Cycloid gearings, which can be recognized in FIG. 3 and have working surfaces 19, which appropriately face one another, are provided on the front faces of the driving part 17 and the driven part 18. By these means, pump working spaces 21, as can be seen in FIG. 2, are formed between the working surfaces 19 and the inner wall of the recess 14.

Figure 3:
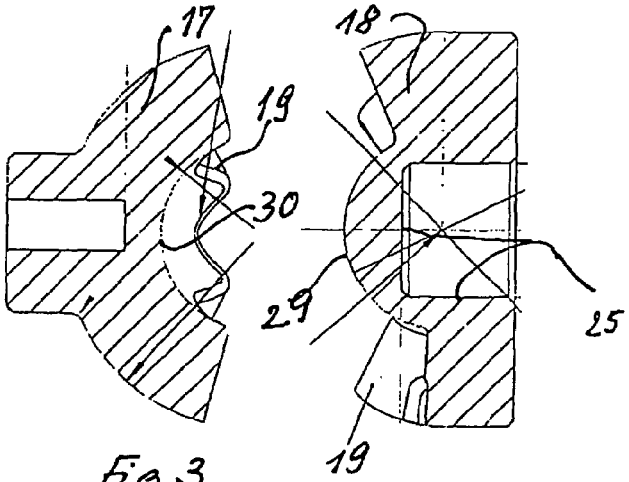
FIG. 3 shows the rotors of the pump, assigned to one another, in a longitudinal section on an enlarged scale, as well as in an exploded representation.

On the driven side, the recess 14 is closed off by a bottom bearing 22, which is disposed at an angle to the axis of the recess 14 in order to achieve the necessary conveying angle and which is sealed from the inner housing 12 at 23. A journal pin 24 is disposed on this bottom bearing 22 perpendicularly to the front face of the bottom bearing 22, which faces the recess 14 and on which the driven part 18 is mounted over a blind borehole 25 (FIG. 3). As can be recognized from FIGS. 1 and 2, the driven part 18 moreover is put under load in the direction of the driving part 17 by a helical spring 26 and a ball 27, the spring being disposed in a blind borehole 28 of the journal pin 24 and the ball being supported at the front face of the blind borehole 25. By these means, good tightness between the working surfaces of the driving part and the driven part is achieved, especially when the delivery pump is started. In addition, the driven part 18 is supported over a spherical surface 29, facing the driving part 17, at a corresponding spherical recess 30 of the driven part 17 (FIG. 3).

Figure 5:
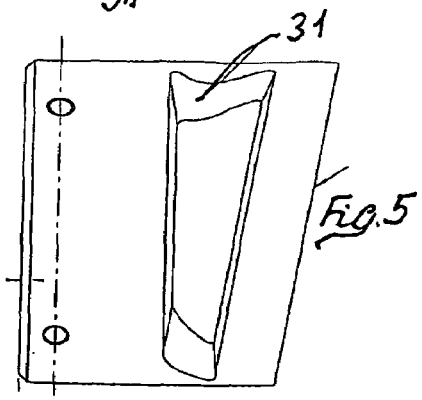
FIG. 5 shows the inner housing in a radial side view.
Figure 6:
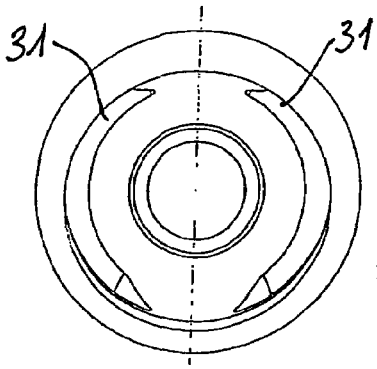
FIG. 6 shows the inner housing in an axial side view corresponding to the arrow VI in FIG. 4.

It can be seen in FIG. 4, 5 and 6 how the delivery process takes place. Fuel is supplied to or removed from the working spaces 21 (FIG. 2) over conveying nodules 31, which are disposed in the walls of the inner housing 12. On the pressure side, the fuel is then passed to the underside of the driven part 18, as a result of which this is put under load in the direction of the driving part 17. However, the latter functions only when the pump has already generated pressure.

All the distinguishing features, presented here, may be essential to the invention individually as well as in any combinations with one another.

LIST OF REFERENCE SYMBOLS

| | |
|---|---|
| 1 | Rotary piston pump |
| 2 | Electric motor |
| 3 | Motor housing |
| 4 | Housing lid |
| 5 | Rotor |
| 6 | Magnet ring |
| 7 | Locking part |
| 8 | Pivot bearing |
| 9 | Pressure connection |
| 10 | Suction connection |
| 11 | Fixed bearing |
| 12 | Inner housing |
| 13 | Housing bushing |
| 14 | Recess |
| 15 | Cylindrical section |
| 16 | Spherical section |
| 17 | Driving part |
| 18 | Driven part |
| 19 | Working surfaces |
| 20 | Shaft of 5 |
| 21 | Pump working spaces |
| 22 | Bottom bearing |
| 23 | Seal |
| 24 | Journal pin |
| 25 | Blind borehole |
| 26 | Helical spring |
| 27 | Ball |
| 28 | Blind borehole |
| 29 | Spherical surface |
| 30 | Spherical recess |
| 31 | Delivery nodules |

The invention claimed is:

1. A rotary piston machine, comprising:

at least two operational rotors mounted for rotation, said operational rotors including a driving part and a driven part, said driving part and said driven part each including front face denticulation collectively forming a boundary of working spaces, respective axes of said driving part and said driven part being disposed at an axial angle relative to one another, said driven part being biased in a direction of the driving part;

a machine housing accommodating said at least two operational rotors;

a pressure conduit and a suction conduit intermittently connectable with said working spaces when said operational rotors are running;

a motor housing and an electric motor housed in said motor housing, said electric motor including a drive rotor mounted in axial alignment with said driving part, said motor housing and said machine housing being interconnected; and a journal pin rotatably supporting said driven part and being disposed approximately at said axial angle with respect to said driving part.

2. A rotary piston machine according to claim 1, wherein a rotational position of said working spaces is alterable relative to said suction and pressure conduits by rotation of said journal pin, thereby permitting adjustment of a working phase of the working spaces in relation to the suction and pressure conduits.

3. A rotary piston machine according to claim 1, further comprising a bottom bearing oriented to support a side of said driven part distant from the driving part, said journal pin being connected with said bottom bearing.

4. A rotary piston machine according to claim 3, wherein the pressure conduit is connected on a side thereof averted from the driving part with a space between the driven part and the bottom bearing.

5. A rotary piston machine according to claim 1, further comprising an inner housing accommodating said operational rotors, said pressure conduit and said suction conduit being open in a direction of said operational rotors and disposed in said inner housing.

6. A rotary piston machine according to claim 5, further comprising a housing bushing in which said inner housing is non-rotationally disposed.

7. A rotary piston machine according to claim 5, wherein said drive rotor includes a shaft supported in a fixed bearing carried on the inner housing at which the driving part is axially supported.

8. A rotary piston machine according to claim 1, wherein said inner housing includes a recess which is open in a direction of the driven part and which is constructed cylindrically and spherically closed in another direction of the driving part.

9. A rotary piston machine accordingto claim 1, wherein said driving part includes an inner spherical region having an appropriately configured front surface on which at least one of the driven part and the journal pin of the driven part is supportable.

10. A rotary piston machine according to claim 1, further comprising a spring, said biasing comprising a force of said spring.

11. A rotary piston machine according to claim 1, wherein:

working surfaces of the driving part and the driven part comprise teeth having spaces therebetween; and transitions between spherical supporting surfaces of the driving part and the driven part, and surfaces of the teeth, include rounding.

12. A rotary piston machine according to claim 11, wherein said rounding has a radius of at least 1 mm.

13. A rotary piston machine according to claim 1, wherein said operational rotors include short circuit conduits formed in a lower surface thereof; via which adjacent working spaces are connectable with one another to achieve pressure equalization for changing capacities of the working spaces.

14. A rotary piston machine according to claim 13, wherein said adjacent working spaces are connectable when one of the suction conduit and the pressure conduit is opened.

* * * * *